US007556714B2

(12) United States Patent
Gray et al.

(10) Patent No.: US 7,556,714 B2
(45) Date of Patent: Jul. 7, 2009

(54) METHOD OF OPERATING A PAPERMAKING PROCESS

(75) Inventors: Ross T. Gray, Plainfield, IL (US); Michael R. St. John, Chicago, IL (US); James L. Thomas, Heber Springs, AR (US); David I. Weinstein, Hawthorn Woods, IL (US); John M. Hawes, Averill Park, NY (US); Mary M. Toney, Wrentham, MA (US)

(73) Assignees: Nalco Company, Naperville, IL (US); Albany International Corporation, Albany, NY (US)

( * ) Notice: Subject to any disclaimer, the term of this patent is extended or adjusted under 35 U.S.C. 154(b) by 316 days.

(21) Appl. No.: 11/522,578

(22) Filed: Sep. 18, 2006

(65) Prior Publication Data

US 2008/0082198 A1 Apr. 3, 2008

(51) Int. Cl.
*D21F 11/00* (2006.01)

(52) U.S. Cl. ..... 162/198; 162/263; 700/128

(58) Field of Classification Search ..... 162/198, 162/263; 700/128
See application file for complete search history.

(56) References Cited

U.S. PATENT DOCUMENTS

| | | | |
|---|---|---|---|
| 4,605,718 | A | 8/1986 | Jansma et al. |
| 4,675,394 | A | 6/1987 | Solarek et al. |
| 4,684,440 | A | 8/1987 | Penniman et al. |
| 5,490,904 | A | 2/1996 | Jansma et al. |
| 5,701,682 | A | 12/1997 | Chuang et al. |
| 6,455,661 | B1 | 9/2002 | Antal et al. |
| 6,468,396 | B2 | 10/2002 | Allen et al. |
| 2003/0111169 | A1 | 6/2003 | Baggot et al. |
| 2005/0161181 | A1 | 7/2005 | St. John et al. |

FOREIGN PATENT DOCUMENTS

| | | |
|---|---|---|
| WO | WO 2006/010268 | 2/2006 |

OTHER PUBLICATIONS

Springer et al., "The influence of fiber, sheet structural properties, and chemical additives on wet pressing," *Tappi Journal*, Apr. 1991, pp. 221-228.

*J. Pulp & Paper Science, Improving Machine Runnability and Paper Properties by a Polymeric Additive*, by M. Laleg and I.I. Pikulik, 1991, 17 (6), pp. 206-216.

*Industrial & Engineering Chemistry Research, Mechanisms of Aldehyde-Containing Paper Wet-Strength Resins*, by Nicole Chen, Shuwen Hu, and Robert Pelton, 2002, 41(22), pp. 5366-5371.

*Nordic Pulp & Paper Research, J., Wet-Web Strength Increases by Chitosan*, by Makhlouf Laleg and Ivan I. Pikulik 1991, 6(3), pp. 99-109.

*Primary Examiner*—Mark Halpern
(74) *Attorney, Agent, or Firm*—Peter A. DiMattia; Michael B. Martin

(57) ABSTRACT

A method of operating a papermaking process containing a press section with at least one press nip is disclosed. The method comprises simultaneously performing the following steps: (a) providing a press media for said papermaking process that has a MFP size that is less than the MFP size of a press media that was originally supplied to said papermaking process; (b) adding an effective amount of one or more press sheet dewatering additives to said papermaking process prior to the last press nip of said papermaking process; (c) providing a sheet moisture ratio of a paper sheet entering a press nip of said press section to between about 2 to about 9; and (d) applying an optimum rate of pressure development at one or more press nips of said papermaking process, wherein said steps a, b, c, and d either: result in the production of a more uniform paper sheet without the reduction in paper solids exiting the press section that would be expected from performing a, c, and d, alone or in combination with one another; or result in the production of a more uniform paper sheet with an increase in solids content of said paper sheet exiting the press section.

15 Claims, 4 Drawing Sheets

FIG. 1

Chemical press dewatering additive trial design run at The Packaging Greenhouse in Karlstad, Sweden.

| Sample | Freeness (ml CSF) | Fabric Design | Press Config | Loading | Roll Impulse (kPa·s) | Shoe Impulse (kPa·s) | Total Impulse (kPa·s) | 64114 Dose (kg/ton) |
|---|---|---|---|---|---|---|---|---|
| 3007 | 250 | A | Shoe | L | 16 | 150 | 166 | 0 |
| 3008 | 250 | A | Shoe | L | 16 | 150 | 166 | 1 |
| 3006 | 250 | A | Shoe | L | 16 | 150 | 166 | 2 |
| 3002 | 250 | A | Roll & Shoe | L | 24 | 150 | 174 | 0 |
| 3014 | 250 | A | Roll & Shoe | L | 24 | 150 | 174 | 0 |
| 3005 | 250 | A | Roll & Shoe | L | 24 | 150 | 174 | 1 |
| 3011 | 250 | A | Roll & Shoe | L | 24 | 150 | 174 | 2 |
| 3003 | 250 | A | Shoe | H | 16 | 300 | 316 | 0 |
| 3015 | 250 | A | Shoe | H | 16 | 300 | 316 | 0 |
| 3001 | 250 | A | Shoe | H | 16 | 300 | 316 | 1 |
| 3013 | 250 | A | Shoe | H | 16 | 300 | 316 | 1 |
| 3012 | 250 | A | Shoe | H | 16 | 300 | 316 | 2 |
| 3004 | 250 | A | Roll & Shoe | H | 40 | 300 | 340 | 0 |
| 3009 | 250 | A | Roll & Shoe | H | 40 | 300 | 340 | 1 |
| 3010 | 250 | A | Roll & Shoe | H | 40 | 300 | 340 | 2 |
| 2005 | 400 | A | Shoe | L | 16 | 150 | 166 | 0 |
| 2011 | 400 | A | Shoe | L | 16 | 150 | 166 | 1 |
| 2012 | 400 | A | Shoe | L | 16 | 150 | 166 | 2 |
| 2001 | 400 | A | Roll & Shoe | L | 24 | 150 | 174 | 0 |
| 2013 | 400 | A | Roll & Shoe | L | 24 | 150 | 174 | 0 |
| 2003 | 400 | A | Roll & Shoe | L | 24 | 150 | 174 | 1 |
| 2015 | 400 | A | Roll & Shoe | L | 24 | 150 | 174 | 1 |
| 2007 | 400 | A | Roll & Shoe | L | 24 | 150 | 174 | 2 |
| 2010 | 400 | A | Shoe | H | 16 | 300 | 316 | 0 |
| 2006 | 400 | A | Shoe | H | 16 | 300 | 316 | 1 |
| 2002 | 400 | A | Shoe | H | 16 | 300 | 316 | 2 |
| 2014 | 400 | A | Shoe | H | 16 | 300 | 316 | 2 |
| 2004 | 400 | A | Roll & Shoe | H | 40 | 300 | 340 | 0 |
| 2009 | 400 | A | Roll & Shoe | H | 40 | 300 | 340 | 1 |
| 2008 | 400 | A | Roll & Shoe | H | 40 | 300 | 340 | 2 |
| 4007 | 250 | B | Shoe | L | 16 | 150 | 166 | 0 |
| 4009 | 250 | B | Shoe | L | 16 | 150 | 166 | 1 |
| 4011 | 250 | B | Shoe | L | 16 | 150 | 166 | 2 |
| 4008 | 250 | B | Roll & Shoe | L | 24 | 150 | 174 | 0 |
| 4012 | 250 | B | Roll & Shoe | L | 24 | 150 | 174 | 1 |
| 4004 | 250 | B | Roll & Shoe | L | 24 | 150 | 174 | 2 |
| 4005 | 250 | B | Shoe | H | 16 | 300 | 316 | 0 |
| 4010 | 250 | B | Shoe | H | 16 | 300 | 316 | 1 |
| 4003 | 250 | B | Shoe | H | 16 | 300 | 316 | 2 |
| 4015 | 250 | B | Roll & Shoe | H | 16 | 300 | 316 | 2 |
| 4002 | 250 | B | Roll & Shoe | H | 40 | 300 | 340 | 0 |
| 4014 | 250 | B | Shoe | H | 40 | 300 | 340 | 0 |
| 4006 | 250 | B | Roll & Shoe | H | 40 | 300 | 340 | 1 |
| 4001 | 250 | B | Roll & Shoe | H | 40 | 300 | 340 | 2 |
| 4013 | 250 | B | Shoe | H | 40 | 300 | 340 | 2 |
| 5007 | 400 | B | Shoe | L | 16 | 150 | 166 | 0 |
| 5010 | 400 | B | Shoe | L | 16 | 150 | 166 | 1 |
| 5006 | 400 | B | Shoe | L | 16 | 150 | 166 | 2 |
| 5004 | 400 | B | Roll & Shoe | L | 24 | 150 | 174 | 0 |
| 5003 | 400 | B | Roll & Shoe | L | 24 | 150 | 174 | 1 |
| 5015 | 400 | B | Roll & Shoe | L | 24 | 150 | 174 | 1 |
| 5001 | 400 | B | Roll & Shoe | L | 24 | 150 | 174 | 2 |
| 5013 | 400 | B | Roll & Shoe | L | 24 | 150 | 174 | 2 |
| 5002 | 400 | B | Shoe | H | 16 | 300 | 316 | 0 |
| 5014 | 400 | B | Shoe | H | 16 | 300 | 316 | 0 |
| 5005 | 400 | B | Shoe | H | 16 | 300 | 316 | 1 |
| 5012 | 400 | B | Shoe | H | 16 | 300 | 316 | 2 |
| 5011 | 400 | B | Roll & Shoe | H | 40 | 300 | 340 | 0 |
| 5008 | 400 | B | Roll & Shoe | H | 40 | 300 | 340 | 1 |
| 5009 | 400 | B | Roll & Shoe | H | 40 | 300 | 340 | 2 |

FIG. 2

Sheet solids and basis weight data for the chemical press dewatering additive trial design run at The Packaging Greenhouse in Karlstad, Sweden.

| Freeness (ml CSF) | Fabric Design | Roll Impulse (kPa s) | Shoe Impulse (kPa s) | 64114 Dose (kg/ton) | Sheet Solids (%) | | | |
|---|---|---|---|---|---|---|---|---|
| | | | | | Pre-couch | Post-couch | Post-roll | Post-shoe |
| 250 | A | 16 | 150 | 0 | 17.2 | 19.9 | 24.0 | 39.5 |
| 250 | A | 16 | 150 | 1 | 17.8 | 19.6 | 23.4 | 39.5 |
| 250 | A | 16 | 150 | 2 | 17.3 | 19.9 | 24.0 | 40.0 |
| 250 | A | 24 | 150 | 0 | 17.2 | 20.2 | 25.8 | 39.7 |
| 250 | A | 24 | 150 | 0 | 17.4 | 19.3 | 26.0 | 39.6 |
| 250 | A | 24 | 150 | 1 | 17.3 | 20.0 | 26.4 | 40.0 |
| 250 | A | 24 | 150 | 2 | 17.7 | 19.9 | 26.7 | 40.2 |
| 250 | A | 16 | 300 | 0 | 17.5 | 19.8 | 23.8 | 42.0 |
| 250 | A | 16 | 300 | 0 | 17.6 | 19.4 | 23.8 | 41.9 |
| 250 | A | 16 | 300 | 1 | 17.6 | 19.9 | 24.2 | 42.2 |
| 250 | A | 16 | 300 | 1 | 17.3 | 19.4 | 23.6 | 42.0 |
| 250 | A | 16 | 300 | 2 | 17.6 | 19.5 | 23.9 | 42.6 |
| 250 | A | 40 | 300 | 0 | 17.2 | 19.5 | 29.2 | 43.0 |
| 250 | A | 40 | 300 | 1 | 17.5 | 20.0 | 29.1 | 43.0 |
| 250 | A | 40 | 300 | 2 | 17.4 | 19.7 | 29.7 | 43.3 |
| 400 | A | 16 | 150 | 0 | 17.7 | 21.4 | 24.1 | 40.9 |
| 400 | A | 16 | 150 | 1 | 17.8 | 21.5 | 24.5 | 41.3 |
| 400 | A | 16 | 150 | 2 | 17.9 | 21.5 | 24.5 | 41.8 |
| 400 | A | 24 | 150 | 0 | 17.5 | 21.9 | 27.7 | 41.2 |
| 400 | A | 24 | 150 | 0 | 17.7 | 21.7 | 26.7 | 41.6 |
| 400 | A | 24 | 150 | 1 | 17.7 | 21.4 | 27.5 | 41.5 |
| 400 | A | 24 | 150 | 1 | 17.7 | 22.0 | 27.4 | 41.7 |
| 400 | A | 24 | 150 | 2 | 17.8 | 21.6 | 27.0 | 41.4 |
| 400 | A | 16 | 300 | 0 | 17.7 | 21.4 | 24.7 | 44.5 |
| 400 | A | 16 | 300 | 1 | 17.8 | 21.4 | 24.2 | 44.4 |
| 400 | A | 16 | 300 | 2 | 17.6 | 21.7 | 24.6 | 44.4 |
| 400 | A | 16 | 300 | 2 | 17.6 | 21.8 | 24.2 | 44.7 |
| 400 | A | 40 | 300 | 0 | 17.7 | 21.2 | 30.2 | 44.8 |
| 400 | A | 40 | 300 | 1 | 17.4 | 21.4 | 30.7 | 45.1 |
| 400 | A | 40 | 300 | 2 | 17.8 | 21.4 | 30.8 | 45.4 |
| 250 | B | 16 | 150 | 0 | 17.5 | 19.4 | 22.5 | 32.4 |
| 250 | B | 16 | 150 | 1 | 17.2 | 19.7 | 22.9 | 32.0 |
| 250 | B | 16 | 150 | 2 | 17.3 | 20.0 | 22.9 | 33.2 |
| 250 | B | 24 | 150 | 0 | 17.6 | 19.6 | 24.3 | 32.9 |
| 250 | B | 24 | 150 | 1 | 17.3 | 19.8 | 24.4 | 33.2 |
| 250 | B | 24 | 150 | 2 | 17.9 | 19.5 | 24.5 | 34.7 |
| 250 | B | 16 | 300 | 0 | 17.5 | 19.6 | 22.5 | 35.7 |
| 250 | B | 16 | 300 | 1 | 17.3 | 19.8 | 22.6 | 36.5 |
| 250 | B | 16 | 300 | 2 | 17.6 | 19.7 | 22.8 | 40.8 |
| 250 | B | 16 | 300 | 2 | 17.3 | 19.4 | 22.8 | 41.4 |
| 250 | B | 40 | 300 | 0 | 17.7 | 19.3 | 26.1 | 41.0 |
| 250 | B | 40 | 300 | 0 | 17.3 | 19.5 | 26.4 | 41.4 |
| 250 | B | 40 | 300 | 1 | 17.4 | 19.8 | 26.7 | 41.7 |
| 250 | B | 40 | 300 | 2 | 18.5 | 19.4 | 26.6 | 41.0 |
| 250 | B | 40 | 300 | 2 | 17.4 | 19.6 | 26.8 | 42.2 |
| 400 | B | 16 | 150 | 0 | 17.7 | 21.5 | 22.9 | 33.3 |
| 400 | B | 16 | 150 | 1 | 17.9 | 21.5 | 23.5 | 33.5 |
| 400 | B | 16 | 150 | 2 | 18.2 | 21.6 | 23.1 | 34.0 |
| 400 | B | 24 | 150 | 0 | 18.1 | 21.5 | 24.9 | 34.7 |
| 400 | B | 24 | 150 | 1 | 18.0 | 21.3 | 25.1 | 35.6 |
| 400 | B | 24 | 150 | 1 | 18.0 | 21.6 | 25.2 | 35.4 |
| 400 | B | 24 | 150 | 2 | 18.3 | 21.6 | 23.8 | 37.6 |
| 400 | B | 24 | 150 | 2 | 18.3 | 21.5 | 25.7 | 38.1 |
| 400 | B | 16 | 300 | 0 | 17.8 | 21.4 | 22.0 | 36.2 |
| 400 | B | 16 | 300 | 0 | 18.1 | 21.5 | 23.9 | 44.5 |
| 400 | B | 16 | 300 | 1 | 18.0 | 21.4 | 23.3 | 38.3 |
| 400 | B | 16 | 300 | 2 | 17.9 | 21.4 | 23.9 | 45.3 |
| 400 | B | 40 | 300 | 0 | 17.9 | 21.9 | 27.6 | 45.5 |
| 400 | B | 40 | 300 | 1 | 17.9 | 21.7 | 26.9 | 45.2 |
| 400 | B | 40 | 300 | 2 | 18.2 | 21.7 | 27.7 | 44.5 |

Final sheet solids as a function of roll press impulse (16, 24, or 40 kPa·s), shoe press impulse (150 or 300 kPa·s), furnish freeness (250 or 400 ml CSF), fabric c type (A or B), and Nalco 64114 dose (0, 1, 2 kg/ton active).

Sheet roughness as a function of roll press impulse (16, 24, or 40 kPa·s), shoe press impulse (150 or 300 kPa·s), furnish freeness (250 or 400 ml CSF), press media type (A or B), and Nalco 64114 dose (0, 1, 2 kg/ton based on solids).

METHOD OF OPERATING A PAPERMAKING PROCESS

FIELD OF THE INVENTION

This invention relates to a method of operating a papermaking process that results in a more uniform paper sheet either without a reduction in the amount of solids exiting the press section or an increase in solids exiting the press section.

BACKGROUND

Improving both dewatering and paper sheet properties exiting the press section are two issues addressed in papermaking. The challenge with these two issues is that an improvement in dewatering at the press section, leading to an increase in the solids content exiting the press section, comes at the expense of sheet properties and the inverse is true as well. Various methods have been employed to address these issues.

A primary driver for dewatering a paper sheet is the application of mechanical pressure to the paper sheet at the press section, particularly at the press nip. More specifically, a paper sheet, which is supported in a press nip by one or more porous media structures, such as press fabrics, is subjected to mechanical pressure at the press nip(s) in the press section.

In the 1970's the relationship between applied pressure and nip residence time was expressed by Beck of Appleton Mills and Busker of Beloit as impulse, which was the product of the two components P (pressure)×t (time). Increasing the impulse typically improves dewatering during pressing and can be achieved by increasing the length of the press nip.

This understanding to extend the time under which pressure is exerted upon the paper sheet was applied first for paper grades that are considered to be flow controlled. The first presses with press nips of extended lengths were large diameter rolls (LDR), followed in 1981 by the first shoe press. Both the LDR and shoe press allowed for significant increases in nip residence time over which the applied pressure could act to dewater the paper sheet. Not only was crushing avoided, but sheet solids were increased compared to the best standard roll presses available.

There are, however, practical limitations to the rate of pressure development applied at the press nip(s), because too high a rate of pressure development will lead to sheet breakage, sheet disruption (crushing), or sheet marking.

Other technologies to enhance water removal were explored. The application of heat to the press section, for example, via steam showers, has improved mechanical removal of water from the press section as well. The application of heat raises water temperature and lowers its viscosity, thus making it easier to mechanically remove water from the sheet. Specifically, a further development not commercialized involves the application of heat directly in the press nip to create a displacement steam front which would not only reduce the viscosity of water, but the steam front as it passes through the sheet would physically displace additional sheet water. Improvements in dryness of up to 10 percentage points were seen with additional improvements in sheet properties. Practical considerations have kept such a process from commercialization.

Other means for fluid displacement have also been taught in the prior art. Air presses have been utilized to force air through the sheet to displace "free water" from the paper sheet. The same was true with other fluids such as foam.

A chemical approach to dewatering a paper sheet in a press section has not been so successful. For example, most chemical drainage aids used in the forming section have not been shown to work in the press section.

In addition, attempts to use soaps or compounds with quaternary amine compounds in pilot trials have resulted in limited success in increasing sheet dewatering during pressing and decreased sheet strength properties due to interference with hydrogen bonding of the cellulose fibers.

Moreover, water insoluble solvents have been introduced into the press nip to replace sheet water. These solvents increase sheet solids exiting the press nips because they displace free water in the paper sheet. Drying rates in the drying section are increased because the solvents are more easily evaporated in the dryer section. This technique is discussed in U.S. Pat. No. 4,684,440 issued to Penniman et al., which is herein incorporated by reference. However, while the mechanism appeared to work for certain light weight paper grades (50 gsm or less), environmental and safety considerations have prevented implementation of this technique.

Both sheet properties and sheet dewatering are affected by the press media structure. More specifically, the press media's Mean Flow Pore (MFP) size influences paper sheet properties. In particular, smaller pore size (denoting a "finer" structure) imparts greater sheet smoothness to the paper sheet in the press nip, a desired outcome. There are practical limitations to press fabric MFP size. Too small a MFP size can have an adverse affect on sheet dewatering, especially of heavier basis weight sheets that are considered to be flow controlled, specifically an increase in fabric flow resistance and an increase in hydraulic back pressure in the sheet at the press nip. In addition, too small of a pore size creates a potential for sheet disruption, sheet breakage, and sheet marking due to an increase in hydraulic pressure

SUMMARY OF THE INVENTION

The present invention provides a method of operating a papermaking process containing a press section with at least one press nip comprising simultaneously performing the following steps: (a) providing a press media for said papermaking process that has a MFP size that is less than the MFP size of a press media that was originally supplied to said papermaking process; (b) adding an effective amount of one or more press sheet dewatering additives to said papermaking process prior to the last press nip of said papermaking process; (c) providing a sheet moisture ratio of a paper sheet entering a press nip of said press section between about 2 to about 9; and (d) applying an optimum rate of pressure development at one or more press nips of said papermaking process, wherein said steps a, b, c, and d either: result in the production of a more uniform paper sheet without a reduction in paper solids exiting the press section that would be expected from performing steps a, c, and d, alone or in combination with one another; or result in the production of a more uniform paper sheet with an increase in solids content of said paper sheet exiting the press section.

BRIEF DESCRIPTION OF THE DRAWINGS

FIG. 1 shows the experimental conditions used on a pilot paper machine to investigate the influence of pressing conditions and the use of a press dewatering chemical on water removal.

FIG. 2 shows sheet solids and basis weight data collected during the pilot paper machine trial described in FIG. 1.

Figure 4:
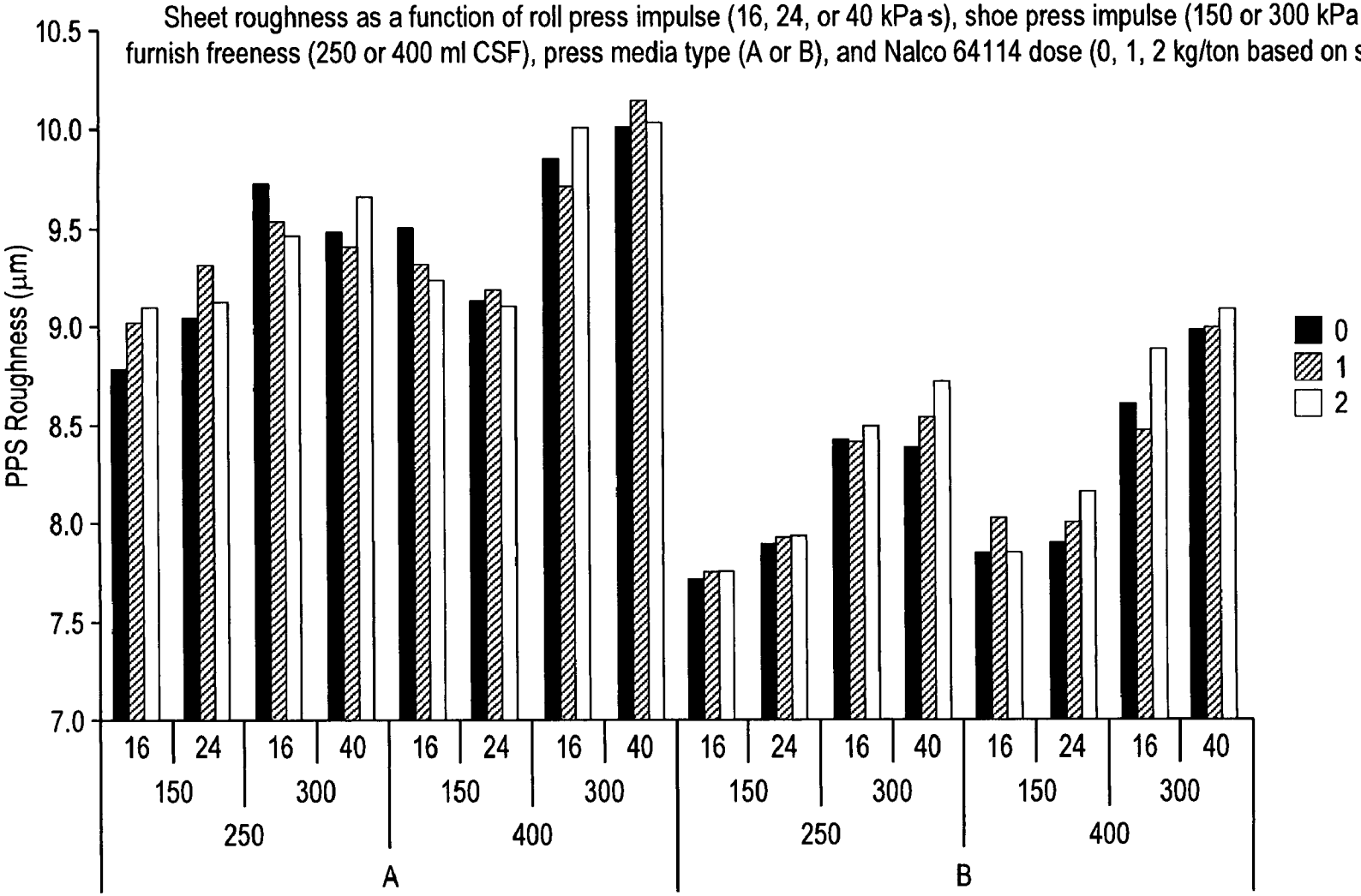

FIG. 4 shows sheet roughness as a function of roll press impulse (16, 24, or 40 kPa·s), shoe press impulse (150 or 300 kPa·s), furnish freeness (250 or 400 ml CSF), press media type (A or B), and Nalco 64114 dose (0, 1, 2 kg/ton based on solids).

DETAILED DESCRIPTION OF THE INVENTION

Definitions:

"Papermaking process" means a method of making paper products from pulp comprising forming an aqueous cellulosic papermaking furnish, draining the furnish to form a sheet, pressing the sheet to remove additional water, and drying the sheet. The steps of forming the papermaking furnish, draining, pressing, and drying may be carried out in any conventional manner generally known to those skilled in the art. The papermaking process also refers to pulp making.

"Press dewatering" refers to the removal of water from the paper sheet under the mechanical load of the presses and their associated parts and can be specified as the total water removal that occurs in the press section or that of any individual pressing operation (a press nip).

"Press sheet dewatering additives" are chemicals added to the papermaking process prior to and/or in the press section of the papermaking process to aid in the dewatering of the sheet.

"MFP" refers to the Mean Flow Pore size of the press media. Mean Flow Pore size is the average pore size of the cumulative distribution of pore sizes in a press media as measured in a liquid extrusion porometer (such as manufactured by Porous Materials, Inc. in Ithaca, N.Y.) using water as the fluid and with the sample compressed to a peak pressure typical for a press nip.

"DADMAC/AcAm" means diallyldimethylammonium chloride/acrylamide.

"OCC" means old corrugated container, also known as cardboard.

"CSF" means Canadian Standard Freeness.

"LDR" means large diameter roll.

Preferred Embodiments of the Invention

The MFP value of the press media is an important parameter for improving dewatering and/or paper sheet properties. Specifically, the method of the claimed invention requires: providing a press media for said papermaking process that has a MFP size that is less than the MFP size of a press media that was originally supplied to said papermaking process.

The press media originally supplied to the papermaking process refers to the press media historically supplied to a specific press nip for a papermaking process, which includes the press media that is utilized prior to practicing the method of the claimed invention. For example, every press section has their own press media that is typically utilized to produce a sheet with certain sheet properties and solids content.

In practice, one of ordinary skill in the art will replace the press media used in the papermaking process with a press media that has a lower MFP than that originally supplied to the papermaking process. The press media with the lower MFP will eventually need to be replaced with a press media with the same MFP size or with one that has a lower MFP value than the press media that was originally used in the papermaking process.

It is known in the art that lowering the MFP value results in an improvement in sheet properties. Lowering the MFP value also increases the hydraulic pressure gradient at the press nip because a press media with a smaller MFP has greater resistance to flow. Too high a hydraulic pressure at the press nip can lead to sheet disruption or crushing, but too low hydraulic pressure can have an adverse effect on dewatering if there is insufficient driving force to remove paper sheet water. This is especially true for heavier basis weight sheets, known as "flow-controlled" sheets.

It has been discovered that the hydraulic pressure in a press nip can be raised to a point where beneficial dewatering occurs by combining the use of a press media, which would normally lead to sheet crushing because of level of hydraulic pressure at the press nip with the addition of press dewatering chemical. Specifically, the press media would have an increase in flow resistance over the maximum value, which would normally lead to sheet crushing.

In one embodiment, the MFP value of the press media entering the press section has a MFP size that is at least 25% less than the press media that was originally supplied to the papermaking process.

The MFP value target range for various paper grades will be different.

In one embodiment, production of fine paper uses a press media with a MFP of about 15 micrometers to about 30 micrometers.

In another embodiment, production of tissue paper uses a press media with a MFP of about 5 micrometers to about 15 micrometers.

In another embodiment, production of paperboard uses a press media with a MFP of about 25 micrometers to about 50 micrometers.

In another embodiment, production of newsprint uses a press media with a MFP of about 15 micrometers to about 30 micrometers.

In another embodiment, production of pulp uses a press media with a MFP of about 30 micrometers to about 70 micrometers.

Sheet moisture ratio entering the press section is one of the parameters that is also important to dewatering a paper sheet because of its effect on system hydraulic pressure. Current best practices yields a paper sheet having a moisture ratio of approximately 0.8 (g $H_2O$/g solids) (for a 125 gsm sheet this would be equivalent to 100 gsm of water) exiting the press section, with the majority of commercial machines in the 1 to 1.3 range. Typical sheet moisture ratios entering the press section range from about 3.0 to 4.0. If the sheet moisture ratio at the press nip is less than about 2.0, the development of hydraulic pressure is generally not high enough to bring about the dewatering benefit of the press sheet dewatering additives added to the papermaking process.

In one embodiment, the sheet moisture ratio entering the press section is from about 2 to about 4. This range is a preferred range in most papermaking operations.

One of ordinary skill in the art would know how to measure sheet moisture ratio in a papermaking process. Sheet moisture ratio can be calculated by measuring the ratio of the amount of water in the paper sheet to the amount of dry fiber in the paper sheet. It can be determined, for example, by taking a grab sample from the papermaking process and determining moisture content gravimetrically.

Applying mechanical pressure at the press nip is another important parameter for improving dewatering in a papermaking process. Maximum sheet dewatering by virtue of an increase in the rate of mechanical pressure applied to a paper sheet and the consequent maximum hydraulic pressure alone, at one or more press nips, has its limitations in that too high of a rate of applied pressure will cause sheet disruption. To combat this adverse effect, the press media, which conveys and supports the paper sheet through the press nip and provides the voids to accept the water that is pressed from the wet paper sheet, can be modified to have a larger MFP size. This step, however, has often proven to adversely affect sheet properties, a result typically not desired by the papermaker. However, an improvement in sheet properties, a more uniform paper sheet, can be produced without a reduction in paper solids exiting the press section that would be expected from performing steps a, c, and d, alone or in combination with one another, or with an increase in the solids content of a paper sheet exiting the press section can occur by simultaneously; controlling the rate of pressure development in the press nip; using a press media with the appropriate MFP size; providing a sheet moisture ratio entering the press nip at a sufficient level; and adding certain press sheet dewatering additives to the system prior to the last press nip.

In one embodiment, the optimum rate of pressure development at the press nip(s) is at least 1500 MPa/sec. At rates less that 1500 MPa/sec, it is unlikely that sufficient sheet hydraulic pressure is developed for the system to be effective. The rate of pressure development applied to the paper sheet varies with the type of paper being manufactured. For example, a rate of 4000 MPa/sec is typical for tissue paper.

Directly measuring the rate of applied pressure in a press nip is not a standard procedure. However, one skilled in the art of press theory would know how to estimate the rate of applied pressure. Using a simulated pressure profile, such as can be obtained using Albany International's proprietary Nip Profile™ software, one can calculate the estimated rate of applied pressure from the tangent slope of the steepest region of the pressure profile. The rate is expressed in units of pressure or stress per unit time (MPa/sec). Alternatively, if a dynamic pressure profile can be directly measured, the rate of applied pressure can be deduced from the measured profile in a similar manner.

The addition of one or more press sheet dewatering additives to the papermaking process prior to the last press nip is also an important parameter for improving dewatering and/or paper sheet properties. For example, if the MFP size of the press media is decreased and the rate of pressure development applied is increased, there is a strong likelihood that sheet crushing will occur in the papermaking process. The use of a press dewatering additive(s) can prevent this.

The application of press sheet dewatering additives to the papermaking process can take place at various locations prior to the last press nip of the press section. For example, press sheet dewatering additives can be applied to the slurry prior to the formation of the sheet or to the paper sheet at the forming section. Press sheet dewatering additive(s) can be applied to the forming section via a spray boom.

Press sheet dewatering additives may include: aldehyde containing polymers; primary and secondary amine containing polymers; and boronic acid containing polymers.

Aldehyde containing polymers may be applied to the papermaking process. Aldehyde containing polymers refer to polymers that contain a free aldehyde group or a latent protected aldehyde group convertible to a free aldehyde.

In one embodiment, the aldehyde containing polymer contains one or more aldehyde functionalized polymers comprising amino or amido groups wherein at least about 15 mole percent of the amino or amido groups are functionalized by reacting with one or more aldehydes and wherein the aldehyde functionalized polymers have a weight average molecular weight of at least about 100,000 g/mole. The preparation of this polymer is discussed in U.S. Patent Application 2005/0161181, which is herein incorporated by reference.

In another embodiment, the aldehyde containing polymer is a glyoxylated DADMAC/AcAM copolymer. The preparation of this polymer is discussed in U.S. Patent Application 2005/0161181. Three products, Nalco 64114, Nalco 64170, and Nalco 64110 are examples of glyoxylated polymers and are available from Nalco Company, 1601 W. Diehl Road, Naperville, Ill., 60563-1198.

In another embodiment, the aldehyde containing polymer is a protected glyoxylated DADMAC/ACAm copolymer. Examples of these polymers are described in U.S. Pat. Nos. 4,605,718 and 5,490,904 and are herein incorporated by reference.

In another embodiment, the press sheet dewatering additives are polymers that contain aldehyde or protected aldehyde polysaccharides. Such polymers are described in U.S. Pat. No. 4,675,394 or J. Pulp Pap. Sci., 1991, 17(6), J206-J216, cationic aldehyde starch commercially available from National Starch as Co-Bond 1000; in Ind. Eng. Chem. Res., 2002, 41, 5366-5371, dextran diethyl acetal; TEMPO (2,2,6,6-tetramethyl-1-piperdinyloxy) oxidized starch, cellulose, or gums, and are herein incorporated by reference.

Primary and secondary amine containing polymers may be applied to the papermaking process.

In one embodiment, the amine containing polysaccharides are chitosan (poly[β-(1,4)-2-amino-2-deoxy-D-glucopyranose]) as described in Nordic Pulp Pap. Res. J., 1991, 6 (3), 99-109, which is herein incorporated by reference, or polysaccharides such as starches or gums derivatized to contain pendant 3-amino-2-hydroxypropyl groups as in U.S. Pat. No. 6,455,661, which is herein incorporated by reference.

In another embodiment, the amine containing synthetic polymers are selected from the group consisting of: polyethylenimine, epichlorohydrin/ammonia condensation polymers, ethylene dichloride/ammonia condensation polymers, polyvinylamine polymers or vinylamine containing polymers, polyallylamine polymers or allylamine containing polymers; and dendrimeric polymers as described in U.S. Pat. No. 6,468,396, which is herein incorporated by reference.

Boronic acid containing polymers may be added to the papermaking process as well.

In one embodiment, boronic acid containing polymers are selected from the group consisting of: hydrolyzed polyformamide, and polyvinylamine derivatized with 4-carboxyphenylboronic acid. These polymers as well as other boronic acid containing polymers are described in WO 2006/010268 and this publication is herein incorporated by reference.

The amount of chemical press dewatering additives added to the papermaking process depends upon the type of papermaking process.

In one embodiment, the press sheet dewatering chemical additives are added in an amount from about 0.1 kg/T to about 15 kg/T. In yet another embodiment, the press sheet dewatering additive is added in an amount from about 0.25 kg/T to about 5 kg/T.

The methodologies of the present invention may be applied to many different kinds of papermaking processes. In one embodiment, the papermaking process is selected from the group consisting of: a papermaking process for production of fine paper; a papermaking process for the production of tissue paper; a papermaking process for the production of paperboard; a papermaking process for the production of newsprint; and a papermaking process for the production of a pulp sheet. The following example is not meant to be limiting.

EXAMPLE

A press section trial on a pilot paper machine was conducted at The Packaging Greenhouse in Karlstad, Sweden. The objective of the trial was to determine the effects of press media structure, press configuration, stock freeness, press mechanical load, and Nalco 64114 (glyoxylated DADMAC/AcAm polymer available from Nalco Company, Naperville, Ill. USA) dose on sheet dryness out of the press section. The trial was a full factorial design with five factors. Four of the factors had two levels and the fifth, chemical additive dose, had three levels. The factors and levels were:

1. Press configuration (shoe press alone or roll press followed by shoe press).
2. Press load (low level—120 kN/m in roll press; 750 kN/m in shoe press; or high level—200 kN/m in roll press and 1500 kN/m in shoe press).
3. Press media design (A: MFP size=30 μm, B: MFP size=15 μm).
4. Freeness (low=250 ml CSF or high=400 ml CSF).
5. Nalco 64114 Dose (0, 1, or 2 kg/ton based on solids).

The experimental design consisted of 60 runs. This included three replicate experiments run on each day. It was determined that the roll press could not be unloaded completely for the conditions that called for use of a shoe press alone. This changed the design because the shoe press alone was actually run using a line load of 80 kN/m on the roll press. The main design in its final form was summarized in the table of FIG. 1. The experiments were randomized within each day. The roll and shoe press pressures were expressed as press impulse in kPa·s. This is the actual applied press load (kN/m) divided by the machine speed (m/s).

The factors that were held constant during the trial included furnish composition, machine speed, basis weight, and degree of press media saturation. The furnish was a simulated OCC obtained by repulping rolls of finished virgin linerboard produced at a Swedish linerboard mill. The machine speed was fixed at 300 m/min, the target basis weight was 150 g/m$^2$, and the press media were kept saturated by adjusting the Uhle box vacuum. Saturated means that the ingoing press media moisture content is such that the press media is completely saturated in the loaded press nip. This saturated condition is required to maximize water removal.

Sheet grab samples were taken at multiple locations: just prior to the couch (pre-couch), after the couch and before the roll press (post-couch), after the roll press and before the shoe press (post-roll), and after the shoe press (post-shoe—final sheet solids). Sheet solids were determined gravimetrically for each sample by drying overnight in a 105° C. oven. The sheet solids measurement results were summarized in the table of FIG. 2. Each sheet solids value listed was the average of two measurements.

Figure 3:
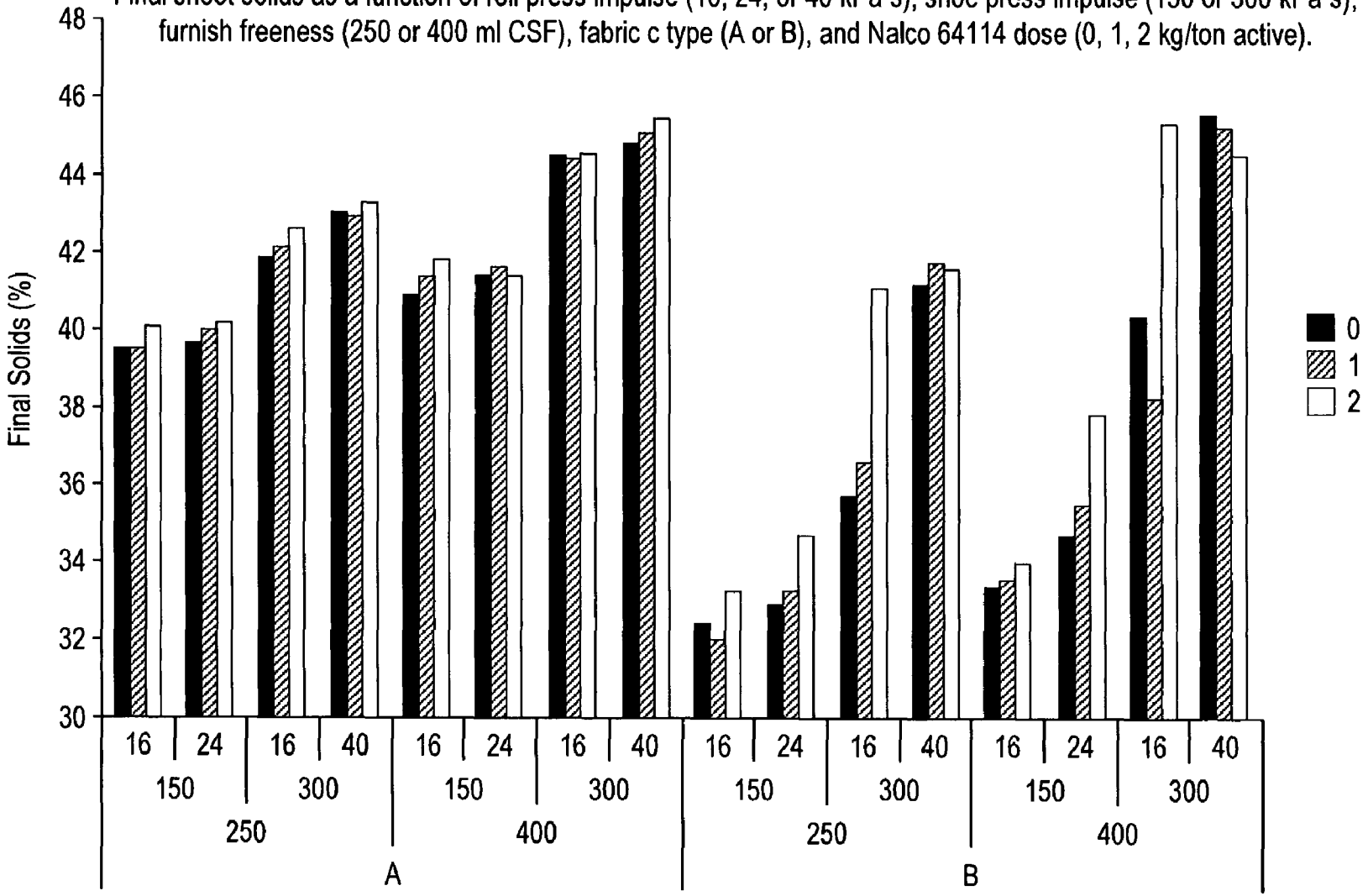
FIG. 3 shows final sheets solids as a function of roll press impulse (16, 24, or 40 kPa·s), shoe press impulse (150 or 300 kPa·s), furnish freeness (250 or 400 ml CSF), press media type (A or B), and Nalco 64114 dose (0, 1, 2 kg/ton based on solids).

A press sheet dewatering additive was found to increase final sheet solids a small, but significant amount for most pressing conditions. However, the chemical press sheet dewatering additive increased sheet solids by a surprising 5-6% when the roll press impulse was low (16 kPa·s) and the shoe press impulse was high (300 kPa·s) when using press media B and either furnish freeness level. This impact was depicted in FIG. 3 in contrast to the other pressing conditions where the impact of the press sheet dewatering additive was small. The pressing condition where the large press sheet dewatering additive effect existed was when the maximum amount of water in the sheet entered the shoe press (low roll press pressure with press media B) and the shoe press pressure was high with press media B providing a high resistance to water removal.

The roughness of the sheets was measured according to TAPPI Test Method T 555 om-99 using the Parker Print Surf (PPS) device. This technique presses a ring of metal against the surface of the sheet and measures the airflow at constant pressure between the surface of the sheet and the ring. This air flow is used to calculate a roughness value (μm). The test was run at 10 locations on each side of each sheet using the soft rubber backing and a clamp pressure of 1 MPa. The average roughness values of the top and bottom of the sheets were plotted in FIG. 4. Generally, the top and bottom of the sheets had equivalent roughness. The sheets produced using press media B, with the smaller MFP size, were significantly smoother than the sheets produced using press media A.

The use of a low roll press pressure, a high shoe press pressure, and Nalco 64114 allowed the production of a smoother sheet through the use of a press media with a smaller MFP size without the loss of sheet dewatering in the press section compared to the use of the same conditions with the higher MFP size press media.

The invention claimed is:

1. A method of operating a papermaking process containing a press section with at least one press nip comprising simultaneously performing the following steps:

a. providing a press media for a press section of said papermaking process that has a Mean Flow Pore (MFP) size that is less than the MFP size of a press media that was originally supplied to said papermaking process;

b. adding an effective amount of one or more press sheet dewatering additives to said papermaking process prior to a last press nip of said at least one press nip in said press section of said papermaking process;

c. providing a paper sheet entering a press nip in said press section, wherein said paper sheet has a sheet moisture ratio of between about 2 to about 9 and wherein said paper sheet is transferred through said press section by said press media; and d. applying an optimum rate of pressure development at said press nip in said press section of said papermaking process so that said pressure is applied to said paper sheet when it enters said press nip, wherein said steps a, b, c, and d either: result in the production of a more uniform paper sheet without the reduction in paper solids exiting the press section that would be expected from performing a, c, and d, alone or in combination with one another; or result in the production of a more uniform paper sheet with an increase in solids content of said paper sheet exiting the press section.

2. The method of claim 1 wherein said papermaking process is selected from the group consisting of: a papermaking process for production fine paper; a papermaking process for the production of tissue paper; a papermaking process for the production of paperboard; a papermaking process for the production of newsprint; and a papermaking process for the production of a pulp sheet.

3. The method of claim 2 wherein said papermaking process for fine paper uses a press media with a MFP of about 15 micrometers to about 30 micrometers.

4. The method of claim 2 wherein said papermaking process for tissue paper uses a press media with a MFP of about 5 micrometers to about 15 micrometers.

5. The method of claim 2 wherein said papermaking process for paperboard uses a press media with a MFP of about 25 micrometers to about 50 micrometers.

6. The method of claim 2 wherein said papermaking process for newsprint uses a press media with a MFP of about 15 micrometers to about 30 micrometers.

7. The method of claim 2 wherein said papermaking process for a pulp sheet uses a press media with a MFP of about 30 micrometers to about 70 micrometers.

8. The method of claim 1 wherein said sheet moisture ratio is from about 2 to about 4.

9. The method of claim 1 wherein said optimum rate of pressure development is at least 1500 Mpa/sec.

10. The method of claim 1, wherein said chemical press dewatering additive is added to a papermaking slurry prior to the formation of the sheet or to a paper sheet in the forming section of a papermaking process.

11. The method of claim 1 wherein said chemical press dewatering additive is added in an amount from about 0.1 kg/T to about 15 kg/T.

12. The method of claim 1 wherein said chemical dewatering additive is added in an amount from about 0.25 kg/T to about 5 kg/T.

13. The method of claim 1 wherein said press sheet dewatering additive is a glyoxylated DADMAC/AcAm copolymer.

14. The method of claim 1 wherein said MFP size of the press media has a MFP size that is at least 25% less than the press media that was originally supplied to the papermaking process.

15. The method of claim 1 wherein said press sheet dewatering additive is an aldehyde containing polymer which contains one or more aldehyde functionalized polymers comprising amino or amido groups wherein at least about 15 mole percent of the amino or amido groups are functionalized by reacting with one or more aldehydes and wherein the aldehyde functionalized polymers have a weight average molecular weight of at least about 100,000 g/mole.

* * * * *